US008303282B2

(12) United States Patent
Goetschenberg et al.

(10) Patent No.: US 8,303,282 B2
(45) Date of Patent: Nov. 6, 2012

(54) GEAR PUMP FOR A POWER STEERING SYSTEM

(75) Inventors: Olaf Goetschenberg, Meerbusch (DE); Martin Jordan, Duesseldorf (DE); Michael Scholand, Wuelfrath (DE)

(73) Assignee: TRW Automotive GmbH, Alfdorf (DE)

( * ) Notice: Subject to any disclaimer, the term of this patent is extended or adjusted under 35 U.S.C. 154(b) by 799 days.

(21) Appl. No.: 12/302,557

(22) PCT Filed: May 25, 2007

(86) PCT No.: PCT/EP2007/004672

§ 371 (c)(1), (2), (4) Date: Jun. 30, 2009

(87) PCT Pub. No.: WO2007/137781

PCT Pub. Date: Dec. 6, 2007

(65) Prior Publication Data

US 2009/0304541 A1 Dec. 10, 2009

(30) Foreign Application Priority Data

May 30, 2006 (DE) ..... 10 2006 025 182

(51) Int. Cl.
*F03C 2/00* (2006.01)
*F03C 4/00* (2006.01)
*F04C 2/00* (2006.01)

(52) U.S. Cl. ..... 418/132; 418/149; 418/206.1; 418/206.6

(58) Field of Classification Search ..... 418/131, 418/132, 206.1–206.9, 178–179, 149
See application file for complete search history.

(56) References Cited

U.S. PATENT DOCUMENTS

| | | | | |
|---|---|---|---|---|
| 2,742,862 | A * | 4/1956 | Banker | 418/132 |
| 3,068,804 | A | 12/1962 | Thrap et al. | |
| 4,245,969 | A | 1/1981 | Gaslow et al. | |
| 4,253,808 | A * | 3/1981 | White | 418/132 |
| 4,400,146 | A * | 8/1983 | Dworak et al. | 418/132 |
| 5,022,837 | A | 6/1991 | King et al. | |
| 5,273,411 | A * | 12/1993 | Lipscombe | 418/132 |
| 2004/0265147 | A1 | 12/2004 | Kiefer | |
| 2006/0051230 | A1 | 3/2006 | Jordan | |
| 2006/0165544 | A1 | 7/2006 | Lettner et al. | |

FOREIGN PATENT DOCUMENTS

| | | | |
|---|---|---|---|
| DE | 1821554 | U | 11/1960 |
| DE | 10048242 | A1 | 4/2002 |
| DE | 20302535 | U1 | 6/2003 |
| DE | 10250554 | A1 | 5/2004 |
| DE | 10356807 | A1 | 12/2004 |

(Continued)

OTHER PUBLICATIONS

Griese, K.: "Zahnradpumpen Und -Motoren", 0+P Olhydraulik Und Pneumatik, Vereinigte Fachverlage, Mainz, DE, Bd. 42, Nr. 9, Sep. 1998, Seiten 564-571, XP000831871 ISSN: 0341-2660 Absatz [02.2]; Abbildung 1A.

(Continued)

*Primary Examiner* — Theresa Trieu
(74) *Attorney, Agent, or Firm* — MacMillan, Sobanski & Todd, LLC

(57) ABSTRACT

The invention relates to a gear pump, especially for a power steering system, having a housing, a first cover and a second cover, the first cover being integrated into the housing.

10 Claims, 8 Drawing Sheets

FOREIGN PATENT DOCUMENTS

| | | | | | |
|---|---|---|---|---|---|
| EP | 178392 | A1 | * | 4/1986 | |
| EP | 1441126 | A2 | | 7/2004 | |
| FR | 2831222 | A1 | | 4/2003 | |
| GB | 564235 | A | | 9/1944 | |
| JP | 56020789 | A | * | 2/1981 | ..... 418/132 |
| JP | 2002235678 | A | | 8/2002 | |

OTHER PUBLICATIONS

Search Report and Written Opinion of the International Searching Authority.

German Search Report dated Feb. 15, 2007 in Foreign Case No. DE 10 2006 025 182.2.

* cited by examiner (STATE OF THE ART)

GEAR PUMP FOR A POWER STEERING SYSTEM

CROSS-REFERENCE TO RELATED APPLICATIONS

This application claims priority to International Patent Application No. PCT/EP2007/004672 filed May 25, 2007, the disclosures of which are incorporated herein by reference in their entirety, and which claimed priority to German Patent Application No. 10 2006 025 182.2 filed May 30, 2006, the disclosures of which are incorporated herein by reference in their entirety.

BACKGROUND OF THE INVENTION

The invention relates to a gear pump, especially for a power steering system, having a housing, a first cover and a second cover.

As a rule, such pumps consist of many individual parts such as gaskets, gear wheels, bearing shafts, bearing rests, centering pins, etc., so that their assembly is very demanding. The installation of the pump, for example, into a motor-pump aggregate of a power steering system of a motor vehicle is usually done in an awkward manner using screws or similar fasteners.

Document DE 203 02 535 U1, and corresponding US Publication No. 2006/0051230, describes a hydraulic pump of the generic type that can be used as a prefabricated assembly in a motor-pump aggregate of a power steering system. The end faces of the housing are each closed by a cover, the two covers being held together by at least one holding part. The hydraulic pump is accommodated in a fluid-filled chamber that is pressurized either by the pump itself or by another means. Therefore, when the individual parts of the pump are designed, it can be assumed that the pressure contributes to holding together the individual parts among each other as well as to affixing the pump as an assembly. In this situation, only a small contact pressure of the individual parts is needed to ensure the start-up of the pump. This contact pressure is necessary in order to seal the intake and pressure areas of the pump. Due to the external pressurization of the housing and of the pump cover, there is only little force differential or no force differential at all between the interior of the pump and the space surrounding the pump, so that the wall thicknesses of the above-mentioned components of the pump can be minimized. The configuration of the pump as a prefabricated assembly has the advantage that each pump can be tested before being delivered or before being installed and that the installation as an assembly is much simpler than the installation of numerous separate individual parts. Moreover, when a pump that has been configured in this manner is assembled, it is not necessary to join the two covers individually to the housing. The holding part ensures that the two covers are pressed against the housing without the need for further affixing means. In the publication cited, either screws or a spring element are used as the holding part, the spring element offering the advantage that the height of the covers can be reduced since there is no need for a thread and no screw head has to be accommodated.

BRIEF SUMMARY OF THE INVENTION

The object of the present invention is to further simplify the construction of such a gear pump, especially for a power steering system.

In order to achieve this object, with a gear pump according to the invention having a housing as well as a first cover and a second cover, the first cover is integrated into the housing, and here, the phrase "a first cover integrated into the housing" means especially that the first cover is formed integrally with the housing. The term "housing" is used to refer to the pump housing or to the integrally formed module comprising the pump housing and other housing sections, for example, a motor housing. The integrally formed housing-cover combination is very simple and can be made with small tolerances, for example, by means of extrusion techniques. As a result of the integration of the first cover into the housing, the number of individual components for a gear pump is considerably reduced; for example, gaskets and centering pins between the housing and the first cover can be dispensed with. Another advantage is that the height of the gear pump according to the invention is less than that of the state of the art. Moreover, in the state of the art, the first cover as well as the housing entail dimensional tolerances. Due to the integral design, only the integrated housing remains as a source of tolerances, so that the requirements in terms of dimensional accuracy of this pump housing can be reduced without increasing the tolerances altogether.

The housing of the gear pump can accommodate two intermeshing gear wheels that are each arranged on a bearing shaft, the housing here having two bearing openings for the bearing shafts. Since bearing openings are created in the housing for the bearing shafts of the gear wheels, there is no need for the customarily employed, separate bearing rest.

In the illustrated embodiments, the housing has a tub-like cross section in a longitudinal section that runs through the two bearing openings. With such a cross section, the housing can be made in one piece with little effort, especially by means of an extrusion technique. Moreover, the housing can be made by means of extrusion so as to have almost sharp edges (e.g. with a radius of 0.2 mm) at the transition.

In one embodiment, the contact surface of the housing with the second cover extends perpendicular to a lengthwise direction of the bearing shafts and runs through the center of the gear wheels. As a result, the housing as well as the cover acquire tub-like cross sections with a geometry that is easy to produce by means of extrusion techniques.

Here, a bearing rest can be arranged in the housing on the side facing away from the bearing openings, the two bearing shafts being mounted in this bearing rest. Hence, the gear wheels of the gear pump are securely held via their bearing shafts by the bearing openings of the housing on the one hand and by the bearing rest on the other hand, so that a reliable and proper functioning of the gear pump is ensured.

In this embodiment, a sealing element can be arranged in the bearing rest, said sealing element providing axial compensation. In addition to its bearing function for the bearing shafts of the gear wheels, in this case, the bearing rest concurrently secures the sealing element for the axial compensation. This simplifies the assembly of the gear pump.

In another embodiment, the second cover is arranged on the housing and two bearing openings are made for the bearing shafts in this second cover. Consequently, on the side of the gear wheels facing the second cover, there is no need for a bearing rest for the bearing shafts so that a smaller number of individual components is needed for the gear pump.

The housing of the gear pump may be made of an aluminum alloy. On the one hand, this is easy to process by means of extrusion techniques so that the production of the housing does not pose any problems. On the other hand, the aluminum alloys can be constituted in such a way that the aluminum material forms a low-friction sliding bearing for the bearing shafts of the intermeshing gear wheels. The gear pump thus runs especially smoothly and is correspondingly economical in terms of energy consumption.

These advantages of the aluminum alloy as mentioned for the housing of the gear pump, of course, also apply to the second cover, which may likewise be made of an aluminum alloy.

As an alternative, the second cover arranged on the housing can also be made of steel. It is especially practical for the second cover to be made of steel for the embodiments of the gear pump in which the second cover does not have bearing openings and is produced as an inexpensive stamped part.

In some embodiments, the housing comprises a pump housing and a motor housing. Gaskets and centering pins between the pump housing and the motor housing can be dispensed with, as a result of which the assembly work is simplified and the number of individual components is reduced.

Other advantages of this invention will become apparent to those skilled in the art from the following detailed description of the preferred embodiments, when read in light of the accompanying drawings.

DETAILED DESCRIPTION OF THE INVENTION

Figure 1:
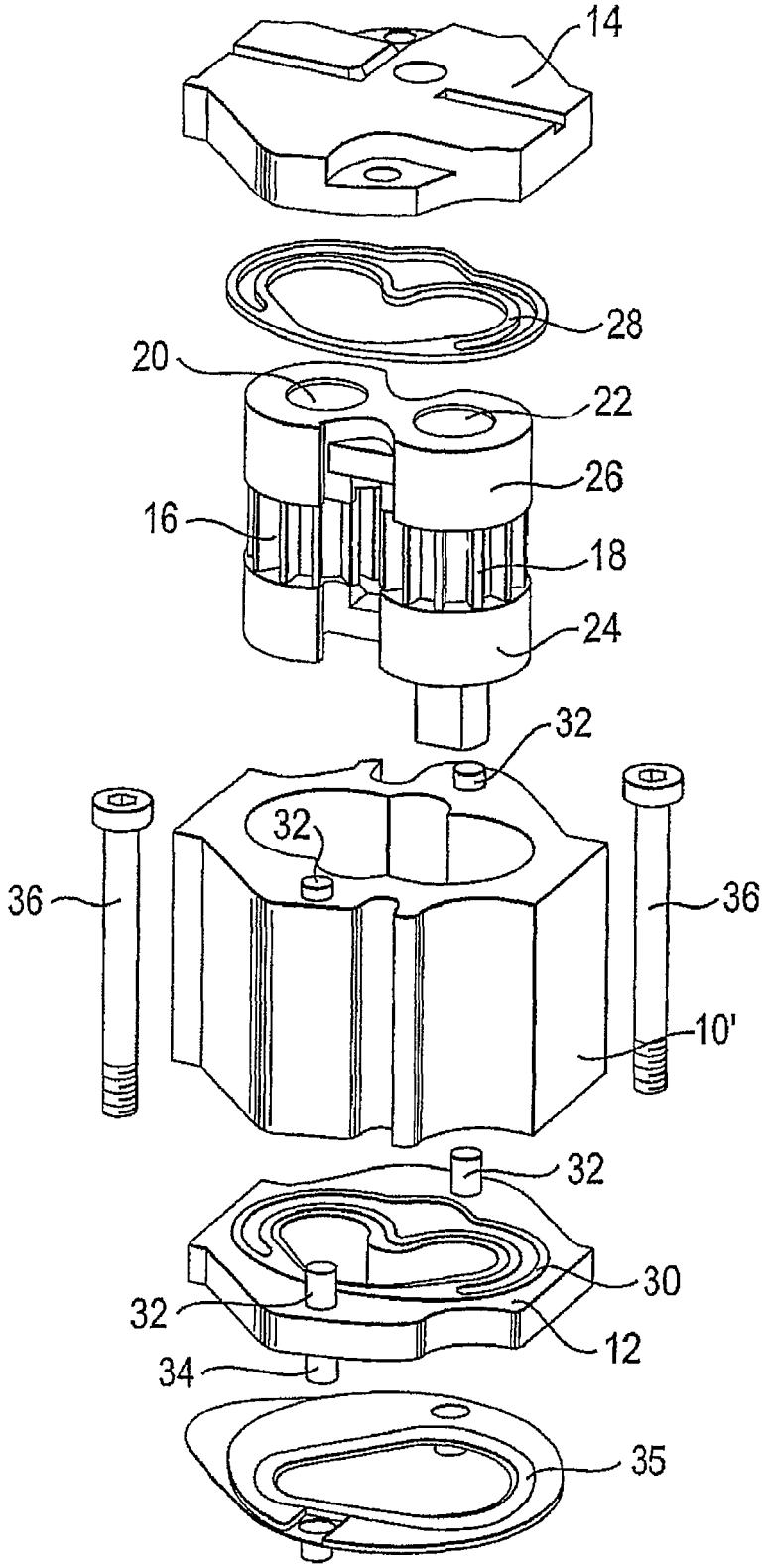
FIG. 1 shows a perspective exploded view of a gear pump according to the state of the art.

FIG. 1 shows a pump according to the state of the art, the pump comprising a hollow-cylindrical housing 10' as well as a first cover 12 and a second cover 14 that can each close the end faces of the housing 10'. The pump shown is a so-called external gear pump whose housing 10' accommodates a set of gear wheels with two intermeshing gear wheels 16, 18 that are each integrally formed with a bearing shaft 20, 22. The bearing shafts 20, 22 are mounted in two opposing bearing rests 24, 26, one of the bearing shafts 20, 22 extending through the first cover 12 out of the housing 10' on one end face (drive shaft 22). A gasket 28 is positioned between the second cover 14 and the housing 10' or the bearing rest 26, and another gasket 30 is provided between the first cover 12 and the housing 10' or the bearing rest 24. In order to correctly position the covers 12, 14, centering pins 32 are attached to the covers 12, 14 and/or to the housing 10' and these centering pins 32 engage in corresponding recesses in the covers 12, 14 and/or in the housing 10'. Additional centering pins 34 are provided on the first cover 12 in order to position the pump in a motor-pump aggregate. Moreover, a pump gasket 35 is provided in order to prevent leakage in the area of openings (intake opening for the hydraulic fluid and opening for the drive shaft 22) provided in the first cover 12. In the embodiment shown, the covers 12, 14 are held together with screws 36 in order to hold the pump as a preassembled unit in its assembled state.

FIGS. 2 to 6 show a gear pump 38 according to the invention; components whose function corresponds to components of the pump according to FIG. 1 have the same reference numerals.

Figure 2:
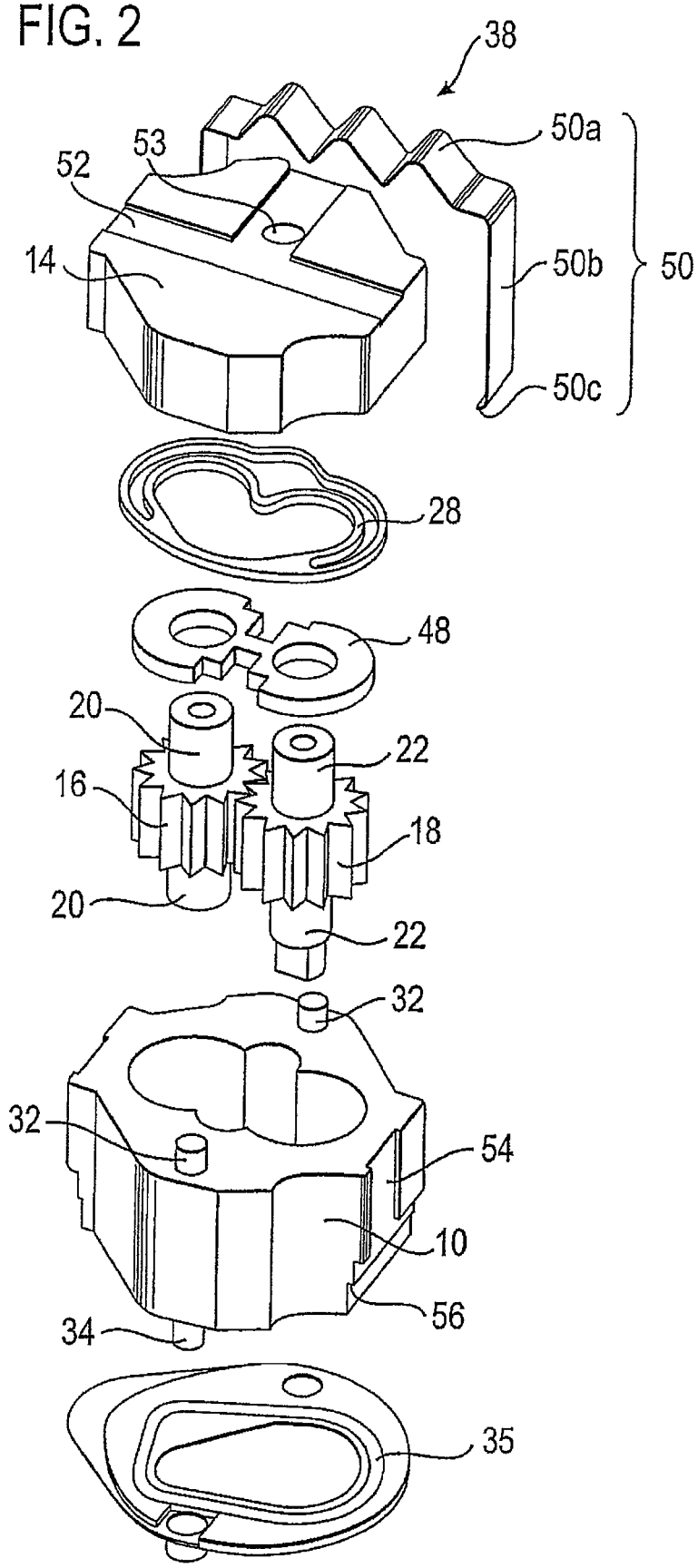
FIG. 2 shows a perspective exploded view of a gear pump according to the invention, in a first embodiment.
Figure 3:
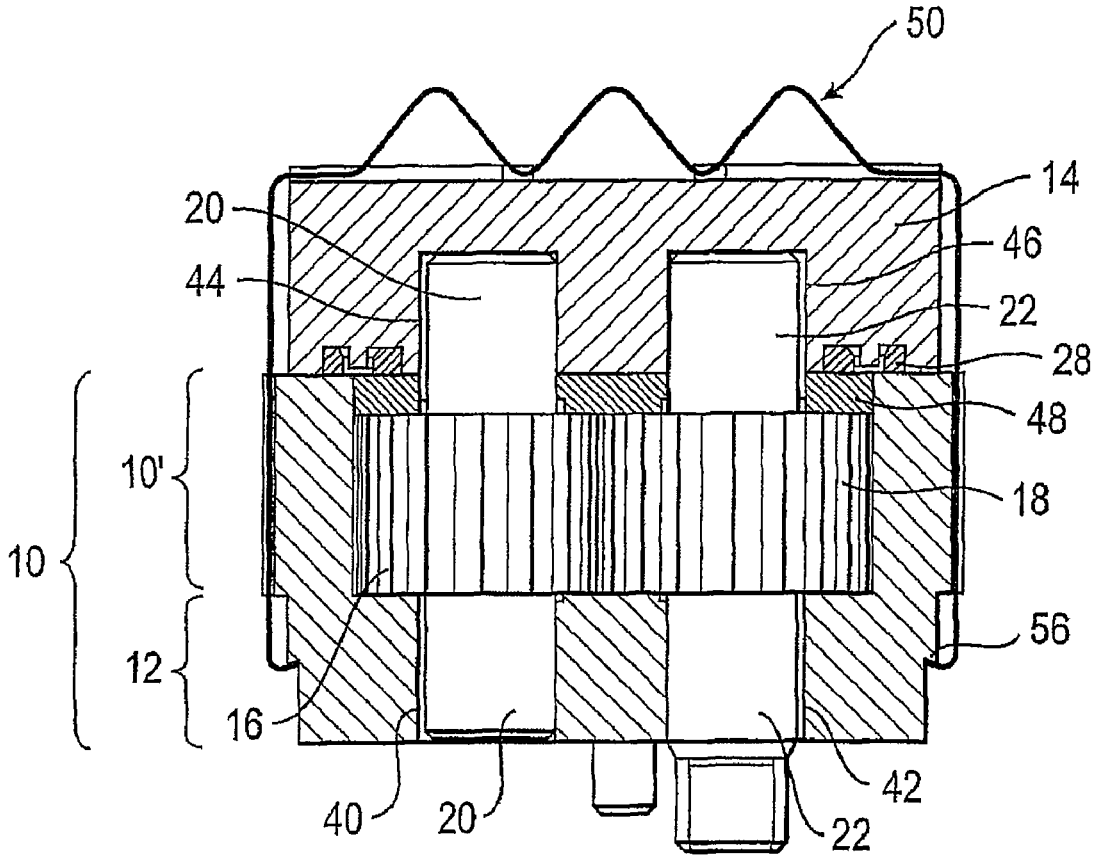
FIG. 3 shows a longitudinal section through the assembled gear pump according to the invention, in the first embodiment as depicted in FIG. 2.

FIGS. 2 and 3 show a first embodiment of the gear pump 38, the first cover 12 being integrated into a housing 10, that is to say, integrally formed with the housing 10' (see FIG. 1). The integrally formed assembly consisting of the housing 10' and the first cover 12 is referred to below as the housing 10.

As can be seen in the longitudinal section in FIG. 3, the two intermeshing gear wheels 16, 18 with their integrally formed bearing shafts 20, 22 are accommodated in the housing 10, which has two bearing openings 40, 42 for the bearing shafts 20, 22. In the longitudinal section in FIG. 3, which runs through the two bearing openings 40, 42, the housing 10 has a tub-like cross section.

The second cover 14, like in the state of the art according to FIG. 1, is configured as a separate component and is arranged on the housing 10. However, the second cover 14 has two bearing openings 44, 46 to accommodate the bearing shafts 20, 22. Since the bearing openings 40, 42, 44, 46 are formed directly in the housing 10 or in the second cover 14, no bearing rests are needed in this case. All that is needed in order to compensate for component tolerances in the axial direction is a compressible, elastic tolerance compensating means 48 which, in the present case, has approximately the shape of a bearing rest.

The gasket 28 is provided in order to create a seal between the second cover 14 and the housing 10 or the tolerance compensating means 48.

In the embodiment of the gear pump 38 according to the invention shown in FIGS. 2 and 3, its components, especially the housing 10 and the second cover 14, are held together by a specially shaped spring element 50. The elastically deformable spring element 50 is stirrup-shaped, with a wavy section **50*a* in the middle, whose ends are followed by two side sections 50*b* bent outwards at a right angle, from which, in turn, two short holding sections 50*c* extend approximately at a right angle. The wavy section 50*a*, at least in some of its contact points with the second cover 14, runs in an indentation 52 of the second cover 14, so as to prevent lateral slippage of the spring element 50. At the same time, the wavy section 50*a* of the spring element 50 serves as a spacer for components that are adjacent to the gear pump 38, thus ensuring an adequate cross section at a pressure outlet 53 of the gear pump 38. In the illustrated embodiment, the two side sections 50***b* lie against the circumferential wall of the housing 10, in grooves 54 in the circumferential wall, and the two holding sections 50*c* reach behind projections 56 of the circumferential wall of the housing 10. By means of the indentation 52 on the second cover 14 and the grooves 54 in the housing 10, the spring element 50 positions the second cover 14 relative to the housing 10. Moreover, as an alternative or additionally, centering pins 32 can be present. Furthermore, one of the further centering pins 34 which ensure a positioning of the gear pump 38 in a motor-pump aggregate can be seen on the housing 10. The pump gasket 35 has to be modified as compared to the state of the art in such a way that, in addition to the intake opening and the bearing opening 42 for the drive shaft 22, it also seals the bearing opening 40 of the bearing shaft 20.

Since the bearing openings 40, 42, 44, 46 in this embodiment constitute sliding bearings for the rotating bearing shafts 20, 22, the second cover 14 and the housing 10 are made of a low-friction aluminum material, for example, an aluminum alloy. Since the cover and the housing do not have a complex shape, in particular, an extruded section can be used as the starting material.

Figure 4:
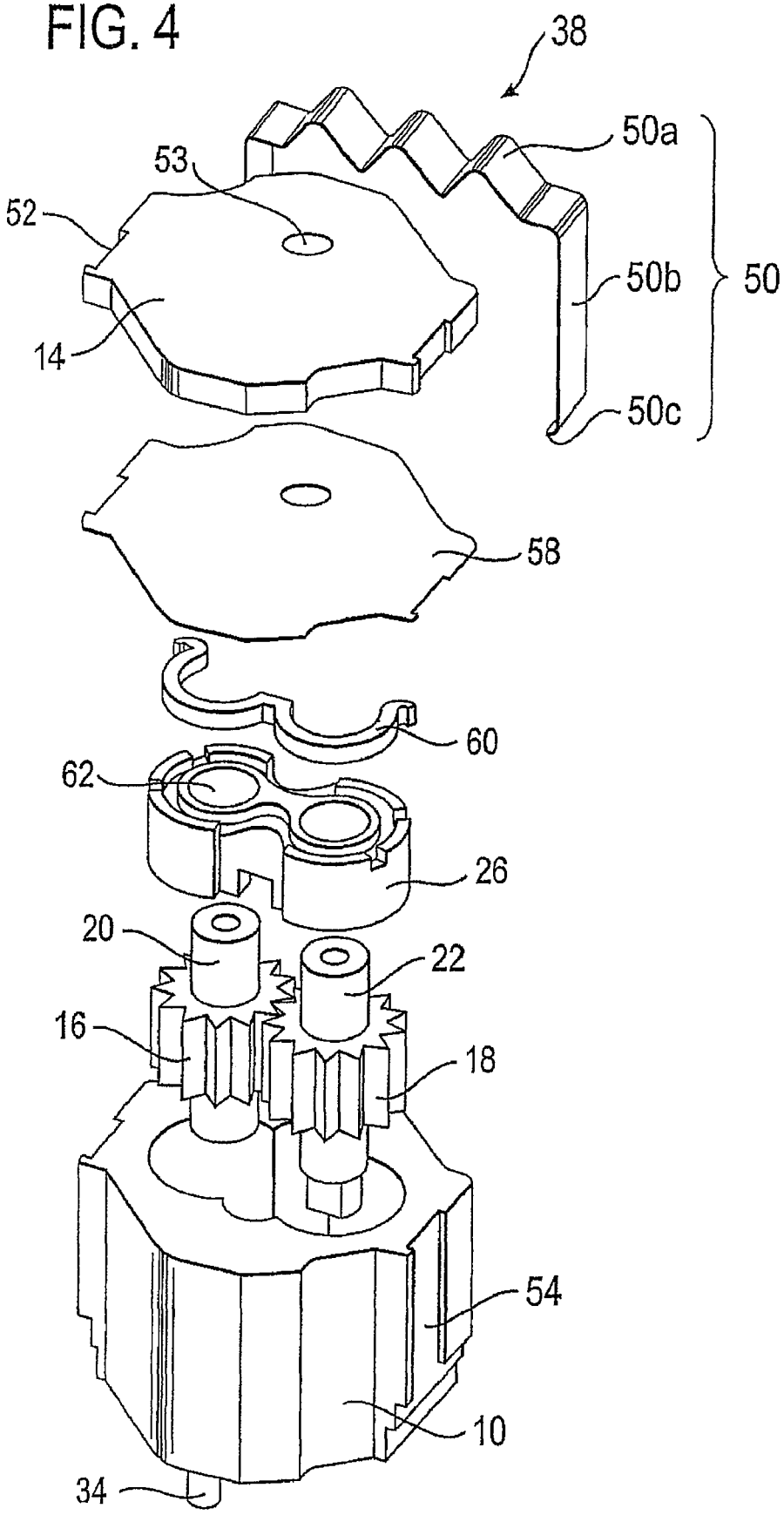
FIG. 4 shows a perspective exploded view of a gear pump according to the invention, in a second embodiment.
Figure 5:
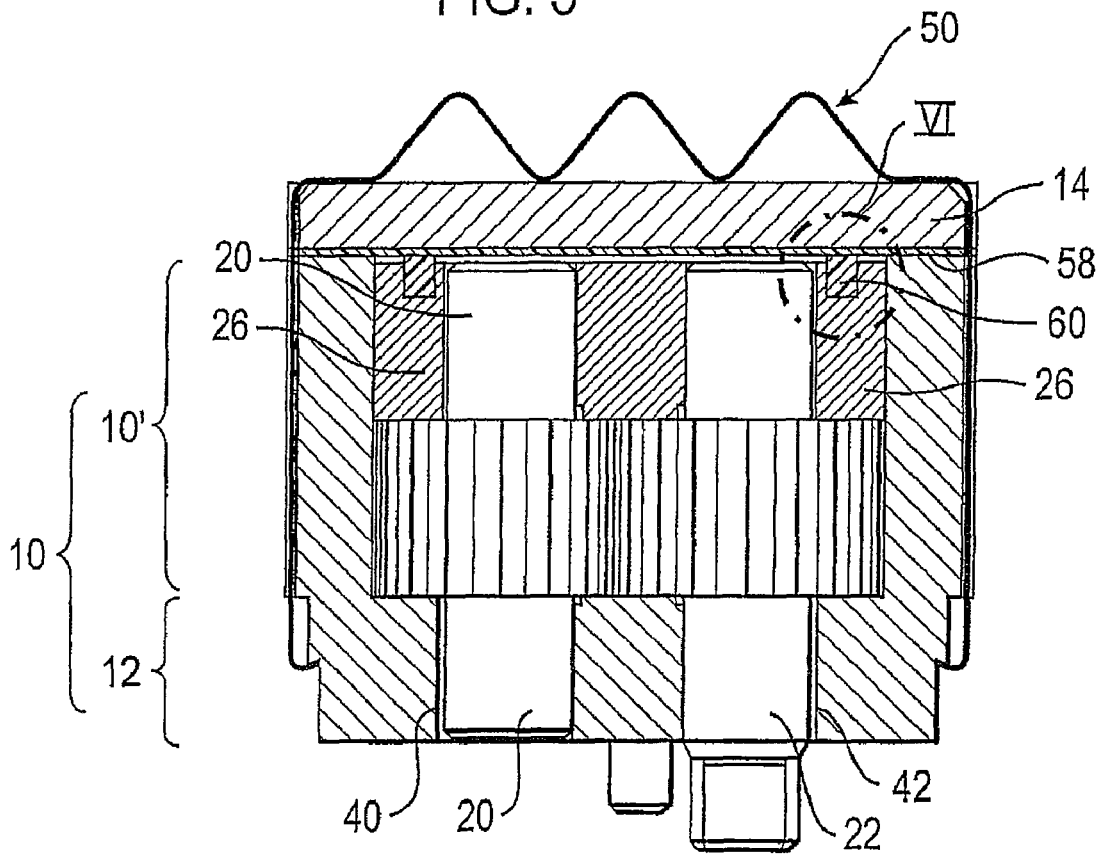
FIG. 5 shows a longitudinal section through the assembled gear pump according to the invention, in the second embodiment as depicted in FIG. 4.
Figure 6:
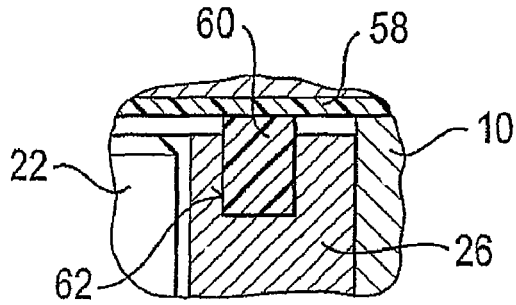
FIG. 6 shows a detail VI of the longitudinal section as depicted in FIG. 5.

FIGS. 4 to 6 show a second embodiment of the gear pump 38, the housing 10' and the first cover 12 according to FIG. 1 once again being formed integrally and designated as the housing 10.

The essential difference from the first embodiment according to FIGS. 2 and 3 is the flat configuration of the second cover 14. As a result, the more complex gasket 28 (see FIGS. 2 and 3) can be replaced by a simple, flat sealing washer 58, a surface area of the sealing washer 58 corresponding to a surface area of the second cover 14 and the sealing washer 58 lying over its full surface on the second cover 14. Since the second cover 14 does not have any bearing openings 44, 46 to accommodate the bearing shafts 20, 22, in this embodiment, the bearing rest 26 (see FIG. 1) is used once again to support the bearing shafts 20, 22. A compressible sealing element 60 is provided in the bearing rest 26, said sealing element 60 providing an axial compensation and thus fulfilling the function of the tolerance compensating means 48 in FIGS. 2 and 3. The sealing element 60 may be laid into a receiving groove 62 of the bearing rest 26, which can be seen especially clearly in FIG. 6, where an enlarged section VI of FIG. 5 is shown. The sealing element 60 is affixed by the receiving groove 62 crosswise to the rotational axes of the bearing shafts 20, 22, whereas, due to its compressibility, it can compensate for component tolerances in the axial direction and it slightly tensions the pump components inside the housing 10 relative to each other and against the housing 10 or the second cover 14 so that the pump components are axially affixed. The axial play is, for example, in the order of magnitude of 0.2 mm. A combination gasket, that is to say, a gasket made up of an elastomer with an integrated support ring, is especially well-suited as the sealing element 60 for a gap of this size. The combination gasket can reliably seal such a gap up to an exerted pressure of approximately 120 bar.

The greater complexity of this second embodiment as a result of the required bearing rest 26 is offset by the simpler production of the flat, disk-like second cover 14. In this case, the second cover 14 can be produced as an inexpensive stamped part, and be made from a material such as steel.

Regarding the other features and advantages of the gear pump 38, which are identical to the first embodiment according to FIGS. 2 and 3, reference is made particularly to the description of the figures of this first embodiment.

Figure 7:
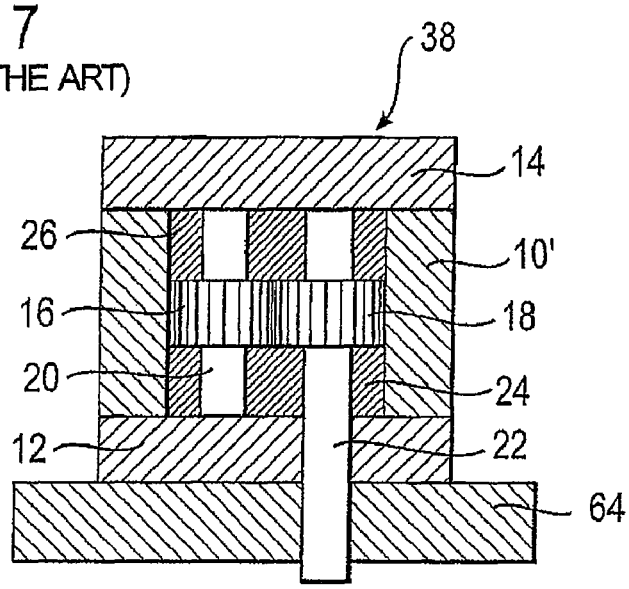
FIG. 7 shows a schematic longitudinal section through a gear pump according to the state of the art.

FIGS. 7 to 15 show schematic longitudinal sections through gear pumps 38, FIG. 7 depicting the state of the art and FIGS. 8 to 15 showing embodiments according to the invention.

The known gear pump 38 in FIG. 1 is depicted as a schematic drawing once again in FIG. 7. It comprises the housing 10', the two separate covers 12, 14, the bearing shafts 20, 22 for the gear wheels 16, 18 as well as the two bearing rests 24, 26. In addition, a separate motor housing 64 is drawn which houses a motor (not shown here) that serves to drive the gear pump 38.

Figure 8:
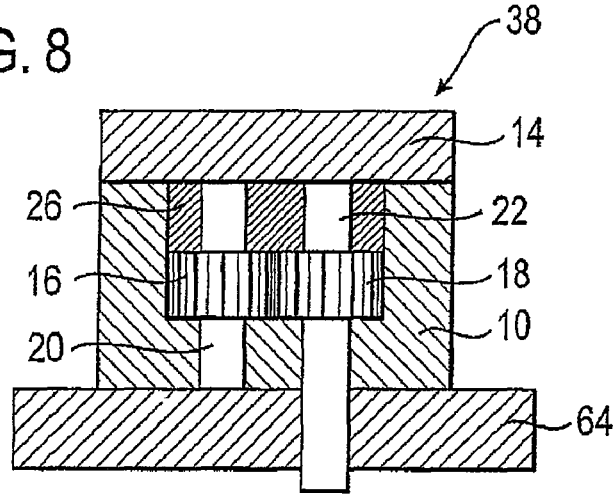
FIG. 8 shows a schematic longitudinal section through the second embodiment of the gear pump according to the invention as depicted in FIG. 5.

The embodiment according to the invention of the gear pump 38 as shown in FIG. 8 corresponds to the second embodiment as shown in FIGS. 4 to 6. The first cover 12 is integrated into the housing 10 and the housing 10 has bearing openings 40, 42 for the bearing shafts 20, 22 so that only the bearing rest 26 is still needed. The second bearing rest 24 is eliminated.

Figure 9:
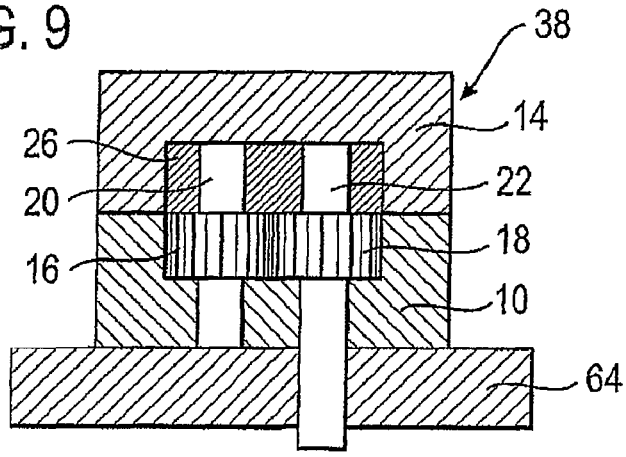
FIG. 9 shows a schematic longitudinal section through the first embodiment of the gear pump according to the invention as depicted in FIG. 3.

The gear pump 38 in FIG. 9 corresponds essentially to the first embodiment as shown in FIGS. 2 and 3, the second cover 14 not having any bearing openings 44, 46 that directly accommodate the bearing shafts 20, 22. Therefore, instead of the tolerance compensating means 48 as shown in FIGS. 2 and 3, the bearing rest 26 is provided to accommodate the bearing shafts 20, 22.

Figure 10:
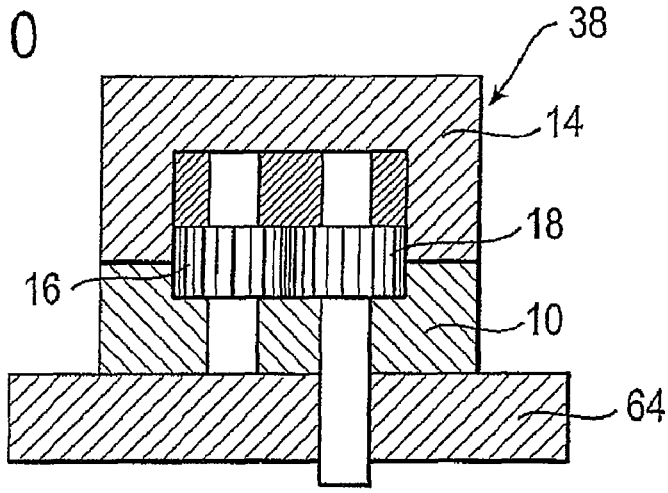
FIG. 10 shows a schematic longitudinal section through a third embodiment of the gear pump according to the invention.

A third embodiment of the gear pump 38 is shown in FIG. 10, in which the second cover 14, as seen in the axial direction of the bearing shafts 20, 22, extends partially over the gear wheels 16, 18. In the present case, the contact surface of the housing 10 with the second cover 14 runs perpendicular to a lengthwise direction of the bearing shafts 20, 22 and through the center of the gear wheels 16, 18.

Figure 11:
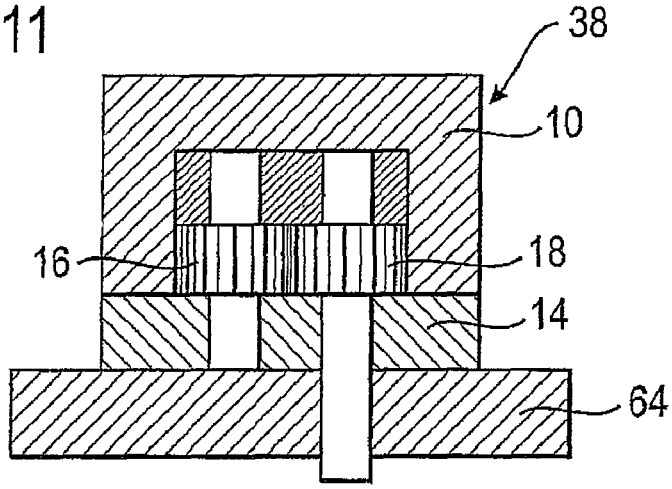
FIG. 11 shows a schematic longitudinal section through a fourth embodiment of the gear pump according to the invention.
Figure 12:
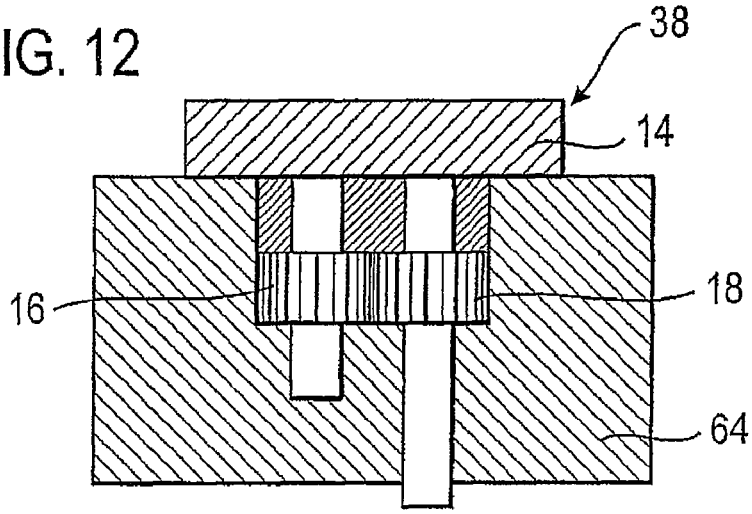
FIG. 12 shows a schematic longitudinal section through a fifth embodiment of the gear pump according to the invention.
Figure 13:
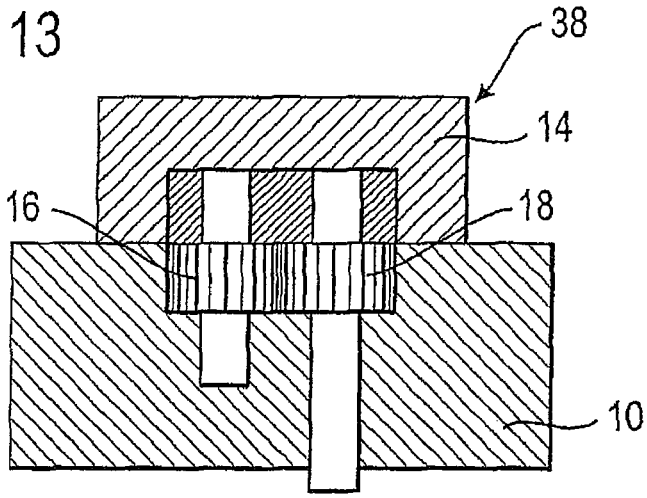
FIG. 13 shows a schematic longitudinal section through a sixth embodiment of the gear pump according to the invention.

In a fourth embodiment according to FIG. 11, the cover adjacent to the motor housing 64, unlike the definition in FIG. 7, is designated as a second cover 14. Accordingly, the first cover is located on the upper edge in FIG. 11 and is integrated into the housing 10.

Figure 14:
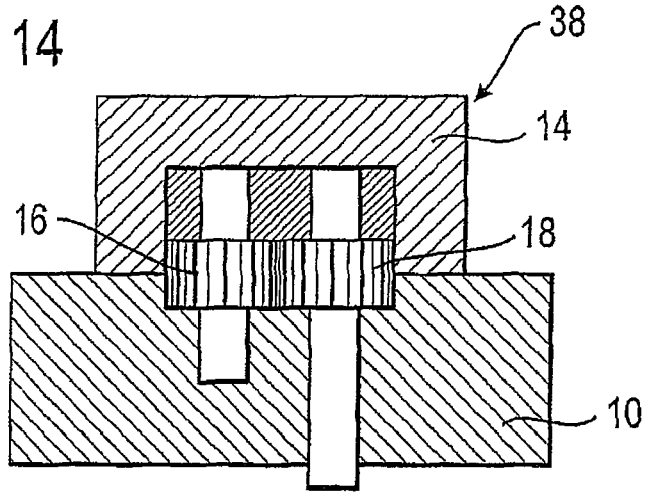
FIG. 14 shows a schematic longitudinal section through a seventh embodiment of the gear pump according to the invention.
Figure 15:
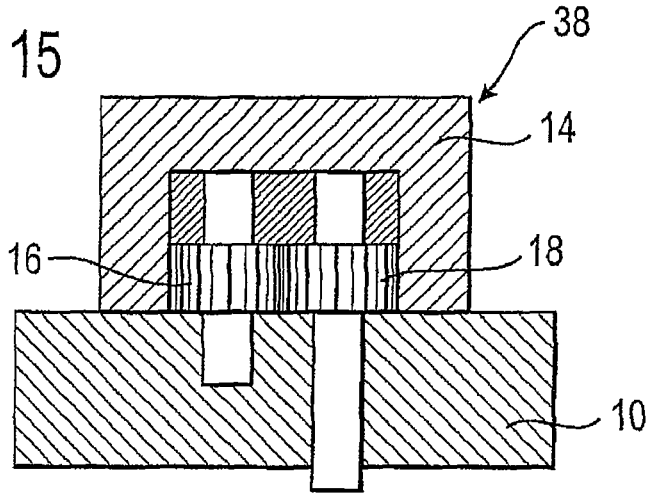
FIG. 15 shows a schematic longitudinal section through an eighth embodiment of the gear pump according to the invention.

FIGS. 12 to 15 constitute a fifth to eighth embodiment of the gear pump 38. In contrast to the embodiments 1 to 4 as shown in FIGS. 8 to 11, the motor housing 64 is integrally formed onto the housing 10 so that the housing 10 is the pump housing as well as the motor housing 64. Due to this integrally formed configuration, the additional centering pins 34 or sealing elements such as the pump gasket 35 are no longer necessary and can be dispensed with (see FIG. 2). As seen in the axial direction of the bearing shafts 20, 22, the second cover 14 in embodiments 5 to 8 only extends to a different distance over the bearing shafts 20, 22 and/or the gear wheels 16, 18. In FIG. 14, the contact surface of the housing 10 with the second cover 14 runs, for example, precisely through the center of the gear wheels 16, 18.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

The invention claimed is:

1. A gear pump for a power steering system comprising:

a housing;

a first cover; and a second cover, wherein the first cover is integrated into the housing, wherein the housing accommodates two intermeshing gear wheels that are each arranged on a bearing shaft, and in that the housing has two bearing openings for the bearing shafts, and wherein a contact surface of the housing with the second cover extends perpendicular to a lengthwise direction of the bearing shafts and runs through a center of the gear wheels.

2. The gear pump according to claim 1, wherein the housing has a tub-like cross section in a longitudinal section that runs through the two bearing openings.

3. The gear pump according to claim 1, wherein a bearing rest is arranged in the housing on the side facing away from the bearing openings, the two bearing shafts being mounted in this bearing rest.

4. The gear pump according to claim 3, wherein a sealing element is arranged in the bearing rest, said sealing element providing axial compensation.

5. The gear pump according to claim 1, wherein the second cover is arranged on the housing and two bearing openings are made for the bearing shafts in this second cover.

6. The gear pump according to claim 1, wherein the housing is made of an aluminum alloy.

7. The gear pump according to claim 1, wherein the second cover is made of an aluminum alloy.

8. The gear pump according to claim 1, wherein the second cover arranged on the housing is made of steel.

9. The gear pump according to claim 1, wherein the housing comprises a pump housing and a motor housing.

10. A gear pump for a power steering system comprising:

a housing;

a first cover; and a second cover, wherein the first cover is integrated into the housing, wherein the housing accommodates two intermeshing gear wheels that are each arranged on a rotating bearing shaft, and in that the housing has two bearing openings for the bearing shafts, the two bearing openings constituting sliding bearings for the rotating bearing shafts, the two intermeshing gear wheels directly adjoining the housing in an axial direction, wherein a bearing rest is arranged in the housing on a side facing away from the bearing openings, the two bearing shafts being mounted in this bearing rest, and wherein a sealing element is arranged in the bearing rest, said sealing element providing axial compensation.

* * * * *